US005253622A

United States Patent [19]

Bornstein et al.

[11] Patent Number: 5,253,622

[45] Date of Patent: Oct. 19, 1993

[54] CAM PHASE CHANGE MECHANISM

[75] Inventors: Irvin Bornstein; Thomas B. Middlebrooks; Scott M. Eddy; Charles E. Benedict, all of Tallahassee, Fla.

[73] Assignee: Bornstein Motor Company, Inc., Tallahassee, Fla.

[21] Appl. No.: 18,714

[22] Filed: Feb. 17, 1993

[51] Int. Cl.[5] ..... F01L 1/04

[52] U.S. Cl. ..... 123/90.17; 123/90.18; 123/90.31

[58] Field of Search ..... 123/90.15, 90.17, 90.18, 123/90.27, 90.31, 90.6

[56] References Cited

U.S. PATENT DOCUMENTS

| | | | |
|---|---|---|---|
| 1,175,395 | 3/1916 | Wixon | 123/405 X |
| 1,632,223 | 6/1927 | Fey | 123/90.17 X |
| 1,787,717 | 1/1931 | Boulet | 123/90.17 X |
| 4,498,352 | 2/1985 | Hedelin | 123/90.17 |
| 4,522,085 | 6/1985 | Kane | 74/568 R |
| 4,870,872 | 10/1989 | Parsons | 123/90.17 |
| 4,917,058 | 4/1990 | Nelson et al. | 123/90.17 |
| 5,090,366 | 2/1992 | Gondek | 123/90.12 X |
| 5,136,887 | 8/1992 | Elrod et al. | 123/90.17 |
| 5,161,429 | 11/1992 | Elrod et al. | 123/90.17 |

FOREIGN PATENT DOCUMENTS

| | | |
|---|---|---|
| 2921645 | 11/1980 | Fed. Rep. of Germany . |
| 1109790 | 2/1956 | France . |

*Primary Examiner*—Willis R. Wolfe
*Assistant Examiner*—Weilun Lo
*Attorney, Agent, or Firm*—Dowell & Dowell

[57] ABSTRACT

A mechanism for controlling the duration of the opening of the intake valve of an internal combustion engine which includes a split cam having a first lobe which is fixed to a primary cam shaft that is drivingly connected to the engine's crankshaft and a second lobe which is freely mounted to the primary cam shaft and which is driven by gears of an auxiliary cam shaft which is axially shiftable, or a segment thereof shiftable, to rotate the second cam lobe relative to the first lobe of the split cam to thereby change the angular relationship between the first and second lobes to advance or retard the closing of the intake valve.

16 Claims, 4 Drawing Sheets

Fig. 4
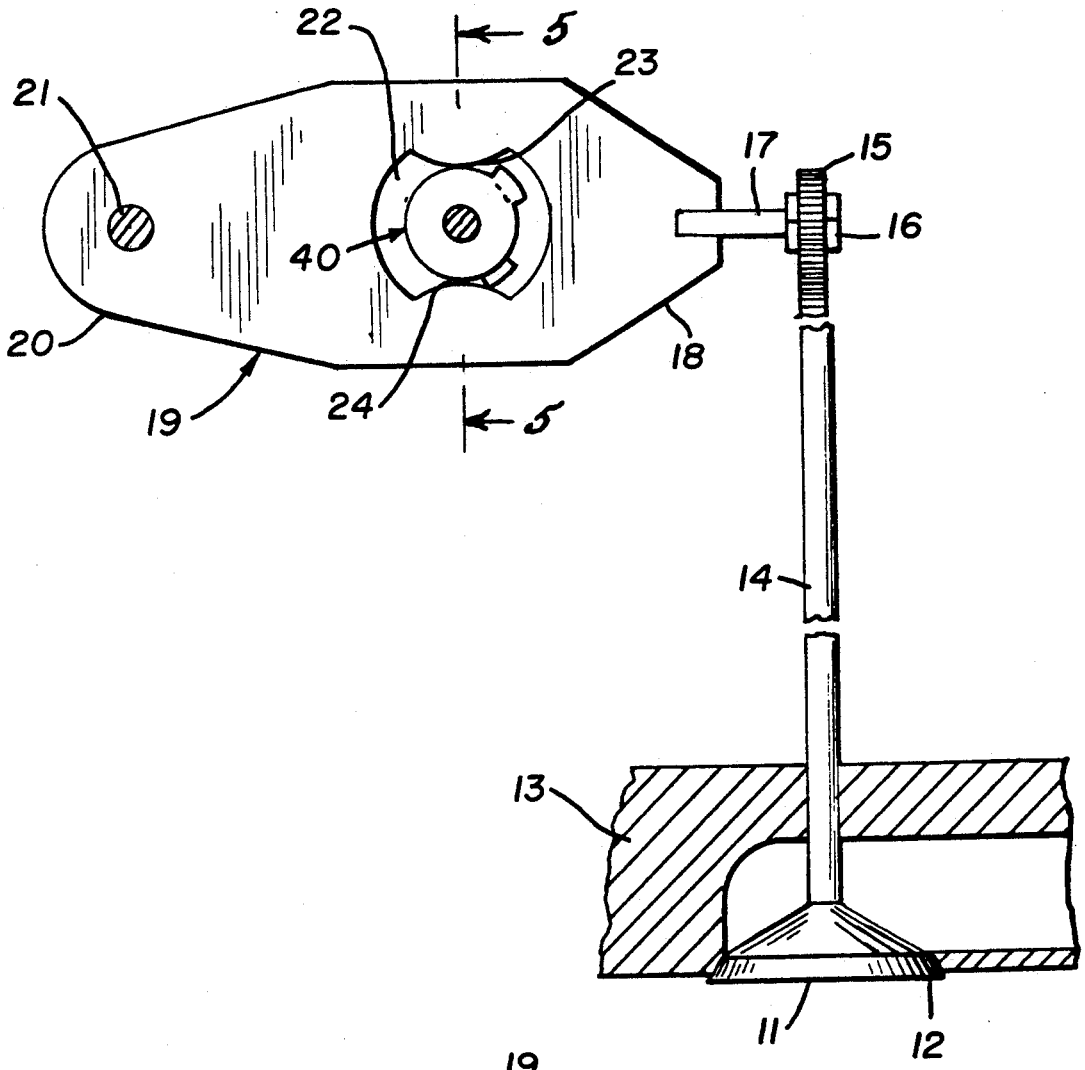
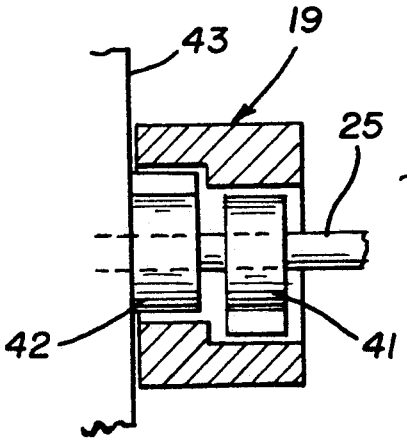
Fig. 5

CAM PHASE CHANGE MECHANISM

BACKGROUND OF THE INVENTION

1. Field of the Invention

This invention is generally directed to timing mechanisms for advancing or retarding the closing of an intake valve into the combustion chamber or cylinder of an internal combustion engine so as to regulate the power developed within the cylinder in proportion to the demand on the engine which demand is controlled by the throttle associated with the engine. More specifically, the present invention is directed to a mechanism for altering the period of closing of the intake valve of an internal combustion engine utilizing a split cam having a first lobe for controlling the opening of the intake valve and second lobe for controlling the closing of the intake valve. The second lobe may be angularly advanced or retarded with respect to the first lobe so as to selectively adjust the duration of opening of the intake valve. With the structure of the present invention the first lobe of the split cam is driven in direct relationship to the rotation of the engine's crankshaft by being fixed to a primary cam shaft. A secondary parallel cam shaft is also provided which is drivingly connected to the primary cam shaft but which is shiftable, or includes segments which are shiftable, relative to the primary cam shaft. A floating drive gear is mounted to the auxiliary cam shaft and engages a gear associated with the second lobe of the split cam in such a manner that, as the auxiliary cam shaft is axially shifted, the second lobe of the split cam will be angularly adjusted relative to the first lobe to thereby alter the duration of opening of the intake valve.

1. History of the Related Art

In internal combustion engines the amount of power developed by the engine and the fuel efficiency of the engine can be controlled by the timing of the intake and exhaust valves. There have been many inventions directed to altering the timing of intake and exhaust valves associated with internal combustion engines by adjusting the drive relationship between the engine's crankshaft which is driven by the pistons and the cam shaft on which cams are mounted for controlling the opening and closing of the valves by way of valve lifters or valve stems.

As engine efficiencies can be increased if the intake and exhaust valves are varied in direct relationship to the engine speed there have been numerous inventions also directed to altering the effective time of compression of a fuel change or in direct response to the engine throttle controls or to the speed of the engine's crankshaft. By varying either the positioning of a cam relative to a cam shaft or by utilizing variable nose cams to increase the effective operable width of the cam during its rotation, variations in the valve opening duration can be achieved.

By controlling the duration that an intake valve is open, the effective power developed by the engine during each piston stroke may be selectively altered. For example, when minimum power is required, if the intake valve is left open after the beginning of the compression stroke of a piston within a cylinder, a portion of the introduced air-fuel mixture will be forced back out through the intake valve and only a portion of the original mixture will be compressed after the valve is closed. However to obtain maximum engine power, the intake valve is closed as the piston reaches it bottom dead center (BDC) position so that the air-fuel mixture will be compressed during the entire compression stroke. In view of the foregoing, engine efficiency is directly related to properly controlling the timing of the opening and closing related to the fuel intake valves.

In U.S. Pat. No. 1,632,223 to Fey, an earlier type of cam control mechanism is disclosed wherein the angular position of the cams relative to the cam shaft may be selectively altered so as to advance or retard the opening and closing of the engine's intake and exhaust valves. Unfortunately, with such an arrangement the duration of opening of intake valves may not be selectively adjusted. Such a mechanism only functions to either advance or retard the timing of the opening but not the duration of the opening and thus does not effectively adjust for optimum fuel efficiency and engine power by controlling the duration of opening of the fuel intake valves or the "dwell" of the valves.

In U.S. Pat. No. 4,917,058 to Nelson et al., a mechanism for controlling the dwell time of either an intake or discharge valve of an internal combustion engine is disclosed. The mechanism includes an outer cam shaft and an inner cam shaft and a split cam having a fix lobe mounted to one of the inner or outer shafts and a selectively adjustable lobe secured to the other of the inner or the outer shafts. By controlling the rotation of the inner and outer shafts relative to one another the dwell or time of opening of either an intake or exhaust valve may be selectively controlled.

In U.S. Pat. No. 4,522,085 to Kane, another type of variable lobe cam mechanism for controlling the duration of opening of an intake valve for an internal combustion engine is disclosed. This invention also utilizes a split cam arrangement for altering the profile of the cam that acts upon a follower or other mechanism for controlling the opening of an intake valve. The cam shaft includes oppositely directed spiral grooves to which each lobe of the split cam are respectively engaged so that as the shaft is shifted axially the angular relationship between the two lobes is directly varied thereby either increasing or decreasing the amount of cam contact surface which controls the timing of the opening of the intake valve. The movement of the cam shaft is controlled by weights which are thrown outwardly by centrifugal force at increased engine speeds thereby shifting the shaft and causing the phase angle change between the split lobes of the intake control cam. Appropriate springs are provided to return the cam to its original lobe configuration as engine speed is reduced. Other patents directed to inventions utilizing cam lobe pairs which act in concert to create a variation in cam lobe dimension are disclosed in U.S. Pat. No. 1,175,395 to Wxion, French Patent 1,109,790 and German Patent 2,921,645. In both the French and German Patents both lobes of the cams are shiftable either by engagement with a concentrically splined shaft or with a sliding rod whereas in the Wxion Patent only one of the lobes of the cams is rotatable relative to the cam shaft.

Other examples of intake valve control cam devices are disclosed in U.S. Pat. Nos. 1,787,717 to Boulet, 2,967,519 to Rossger and 5,090,366 to Gondek.

SUMMARY OF THE INVENTION

This invention is directed to a mechanism for controlling the dwell or time of duration of opening of the intake valve of an internal combustion engine which includes a primary cam shaft which is drivingly connected in a phased relationship with respect to the engine's crankshaft and an auxiliary cam shaft which is mounted in parallel relationship to the primary cam shaft. The auxiliary cam shaft is controlled directly in response to both the primary cam shaft and the engine throttle so as to be continuously responsive to the demand for engine power. A split lobe intake valve control cam includes a first lobe which is fixed to the primary shaft and a second lobe which is rotatably adjustable with respect to the primary cam shaft so as to increase or decrease the surface configuration of the cam to control the dwell timing of the intake valve. A first pair of gears drivingly connect the primary shaft to the auxiliary shaft with the input gear on the auxiliary shaft being splined to ride in diagonal grooves made within the auxiliary shaft in such a manner that the auxiliary shaft may be shifted along its elongated axis without interfering with the rotational interaction of the meshed gears which rotate the shafts at the same rate. Also mounted on the auxiliary shaft is a control drive gear which is slidable relative to elongated splines provided along the auxiliary shaft so as to permit the auxiliary shaft to shift axially with respect thereto. The control drive gear meshes with a cam lobe phase change gear which is freely mounted about the primary cam shaft and which is securely or integrally fixed to the variable cam lobe. Under normal engine operation, the control drive gear of the auxiliary shaft will drive the cam phase change gear and second lobe of the intake control cam at the same rate as the primary cam shaft. However, upon the shifting of the auxiliary cam shaft relative to its axis, the rotational movement created by the spiral engagement of the grooves of the auxiliary cam shaft with respect to the input gear will rotate the control drive gear to change the angular relationship of the second lobe or adjustable lobe of the intake control valve cam relative to the fixed lobe.

In another embodiment, only a segment of the auxiliary shaft is shiftable relative to the elongated axis thereof. In this embodiment, the input gear is freely rotatably mounted to a nonshiftable segment of the auxiliary shaft and is fixedly engaged with a hat section which includes a central bushing through which a first portion of the shiftable segment of the auxiliary shaft extends. The first portion of the shiftable segment and the bushing are cooperatively engaged so that the hat section drives the auxiliary shaft in rotation but allows the shiftable segment to be axially shifted relative to the bushing. The shiftable segment of the auxiliary shaft includes a first end portion having spiral gear teeth which mesh with complementary gear teeth in a socket formed in the mating end of the non-shiftable shaft segment. The other or second end of the shiftable segment is engaged by a control mechanism responsive to the engine throttle conditions. As the shiftable section is axially reciprocated, the meshed engagement of the auxiliary shiftable shaft segment will cause a partial rotational advancing or retarding of the non-shiftable shaft segment. In this embodiment, the control drive gear is fixed to the non-shiftable segment of the auxiliary shaft but remains engaged with the cam lobe phase change gear of the primary cam shaft.

The shifting of the auxiliary shaft, or the shiftable segment thereof, is accomplished by providing either a lever, vacuum canister, pneumatic, hydraulic or electric plunger which is engagable with the auxiliary shaft and which is directly responsive to the engine throttle controls. Such controls may be electronic or computerized in some embodiments.

The invention further includes a cam follower having an opening therein which includes a pair of spaced and offset internal extending lobes for selectively engaging each of the first and second lobes of the split cam of the cam phase change mechanism. The cam follower is situated in surrounding relationship with respect to the split cam and includes one end which is pivotable about a support rod and an outer end which is connected to a portion of the intake valve stem. The connection between the cam follower and the valve stem may be made by way of a flexible spring element which will absorb shock created by the movement of the cam follower and the valve stem.

It is the primary object of the present invention to provide a unique mechanism for controlling the intake valve timing or dwell timing of the intake valve of an internal combustion engine for given fixed bore-stroke combinations so as to control the amount of air-fuel mixture which is compressed during each compression cycle of an internal combustion engine.

It is yet another object of the present invention to provide a unique mechanism for altering the time period in which the intake valve into a cylinder of an internal combustion engine is open so as to maximize engine performance depending upon power demand.

It is also an object of the present invention to provide a unique mechanism for controlling the timing of the intake valve of an internal combustion engine wherein the mechanism includes a split cam having a first lobe continuously driven in direct relationship with respect to the engine's crankshaft and a second cam lobe which is angularly adjustable relative to the first lobe to alter the duration of opening or time of closing, of the intake valve and which is controlled by the axial movement of a parallel cam shaft, or a segment thereof, which is moved in direct response to a vehicle's engine throttle control unit or system so that there are no additional stresses or forces directed to the primary cam shaft during the shifting of the moveable cam lobe.

It is also an object of the present invention to provide a low cost cam phase change mechanism for controlling the dwell timing of the intake valves of an internal combustion engine which utilizes a primary cam shaft and a parallel auxiliary cam shaft wherein the primary cam shaft is directly driven in relationship to the engine's crankshaft but wherein the auxiliary cam shaft is associated with the crankshaft and the throttle controls which regulate the amount of power to be developed by the engine.

BRIEF DESCRIPTION OF THE DRAWINGS

FIG. 4 is an illustrational cross-sectional view of a cam follower mechanism which is mounted in surrounding relationship with respect to the split intake control cam of the present invention showing its relationship with respect to an intake valve of an internal combustion engine.

FIG. 5 is an enlarged cross-sectional view taken along lines 5—5 of FIG. 4.

DESCRIPTION OF THE PREFERRED EMBODIMENT

Figure 1:
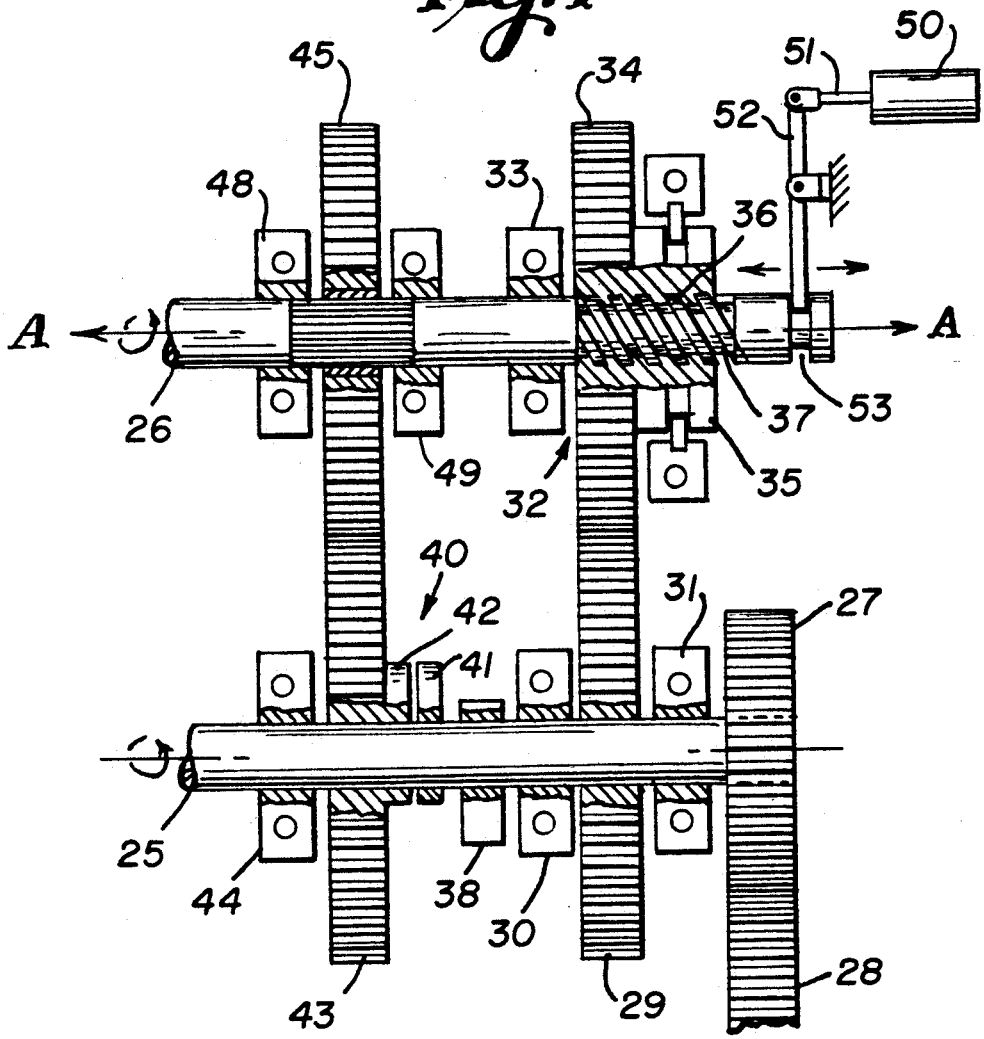
FIG. 1 is a partial cross-sectional top plan view of the cam phase change mechanism of the present invention.

With continued reference to the drawings, the cam phase change mechanism 10 of the present invention is utilized to control the dwell or the duration of opening of a valve 11 associated with a combustion cylinder (not shown) of an internal combustion engine. With specific references to FIGS. 4 and 5, the valve 11 is closeable with respect to a valve seat 12 formed in the head 13 of the engine block. The valve 11 includes a valve stem 14 having upper threaded end portion 15 which is mounted to a spring element 17 by lock nuts 16 secured thereto. The spring element 17 is mounted at the outer end 18 of a cam follower 19 having its opposite end 20 pivotable with respect to a fixed support shaft 21.

The cam follower includes a central opening 22 therethrough having a pair of offset and spaced lobes 23 and 24 which are engagable with the lobes of an intake control valve cam associated with the cam phase control mechanism of the present invention in a manner which will be discussed in greater detail hereinafter.

With specific reference to FIG. 1, the cam phase change mechanism 10 includes a first or primary cam shaft 25 and an auxiliary cam shaft 26 which is spaced generally parallel with respect to the primary shaft. The primary shaft is driven in a predetermined relationship with respect to the engine's crankshaft (not shown) by an input gear 27 which meshes with an output gear 28 associated with a timing device connected to the crankshaft. An output drive gear 29 is also fixedly mounted to the primary cam shaft intermediate a pair of spaced bearings 30 and 31. The output drive gear 29 meshes with an input gear assembly 32 which is mounted about the auxiliary cam shaft 26. The gear assembly 32 is maintained in fixed rotatable relationship with respect to the input drive gear 29 by way of a bearing assembly 33. The input gear assembly includes a gear wheel 34 and hub 35 each of which have a central opening therethrough which includes either a spiral groove or spiral flange or flute 36 which is generally continuous between the two elements so as to be receivable within a spiral groove or to receive a spiral flange 37 provided in the outer surface of the auxiliary cam shaft. In this manner, the input gear assembly 32 is free to rotate at the same rotational speed about the auxiliary cam shaft that the drive gear 29 rotates due to its connection to the primary drive shaft however a lateral shifting of the auxiliary drive shaft is permitted through the spiral engagement of the auxiliary cam shaft 26 and the input gear assembly 32 created by the flange and grooves 36 and 37. It should be noted that the spiral flange may either be provided within the central opening of the gear assembly or may be provided along the outer surface of the auxiliary cam shaft and that the cooperating spiral groove may either be provided in the inner surface of the input gear assembly 32 or within the outer surface of the auxiliary drive shaft 26. Due to the relationship between the auxiliary drive shaft and the input gear assembly 32, a relative rotation may be developed between the auxiliary drive shaft 26 and the gear assembly as the auxiliary cam shaft is shifted axially even though the input gear assembly 32 is mounted thereto and normally drives the shaft at a rate which is the same as the rotational rate of the primary cam shaft 25.

Also mounted to the primary cam shaft is an exhaust valve control cam 38 which is utilized to control the opening and closing of an exhaust valve associated with the internal combustion engine. Mounted adjacent to the exhaust control cam 38 is an intake control valve cam 40 having a first lobe 41 which is fixed to rotate with the primary cam shaft and a second lobe 42 which is freely rotatable mounted about the primary cam shaft. The second lobe 42 of the intake control valve cam 40 is secured to an input cam control gear 43 which is also freely rotatable about the primary cam shaft 25 and which is retained in position by bearing assembly 44. The input cam control gear 43 is driven by a cam drive control gear 45 which is mounted to the auxiliary cam shaft 26. The drive control gear 45 includes a plurality of grooves 46 in the central or hub portion thereof along which extend splines 47 formed in the outer surface of the auxiliary cam shaft. The drive control gear 45 is retained in oriented relationship with respect to the input cam control gear 43 by a pair of spaced bearing assemblies 48 and 49. Due to the splined mounting relationship between the drive control gear 45 and the auxiliary cam shaft, the cam shaft may be shifted laterally with respect to the elongated axis A—A of the auxiliary cam shaft and at the same time cause a rotational advancement or retardation of the drive control gear 45 due to the rotational movement of the auxiliary drive shaft when it is shifted axially through the input gear assembly 32. This advancement or retardation of rotational movement of the drive control gear 45 causes a like advancement or retardation of the rotational movement of the input cam control gear 43 thereby adjusting the angular relationship of the split cam lobe 42 relative to the fixed cam lobe 41 while at the same time permitting both lobes of the split cam to be rotated at the same RPM.

As previously discussed, the control of the adjustable lobe 42 of the split cam 40 is accomplished in direct relationship to the engine throttle control system. In this respect, either mechanically, hydraulically, electronically or pneumatically, a connection is provided between the throttle control system (not shown) and a plunger assembly 50. The plunger assembly includes a slide 51 which actuates a pivot arm 52 which includes an end which is seated within a groove 53 formed in one end of the auxiliary cam shaft. As shown in the arrows in FIG. 1, as the assembly 50 is operated, the shaft is shifted along its axis A—A to either advance or retard the angular relationship of the moveable cam lobe 42 relative to the fixed cam lobe 41.

Figure 3:
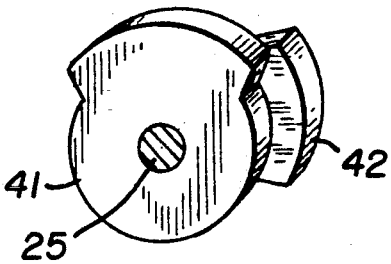
FIG. 3 is an enlarged perspective view of the split cam of the present invention showing the second variable lobe rotated to a position defining the maximum duration for opening of the intake valve into an internal combustion engine thereby providing for minimum compression of an air-fuel mixture at periods of low power demand for the engine.

When power demand is low, such as during idle or cruise conditions, the moveable lobe of the split cam is rotated relative to the fixed lobe to create a cam profile to cause the intake valve to be open for a duration which approaches maximum. This relationship is shown in FIG. 3 of the drawings. At this position, the cam 40 allows a volume of air-fuel mixture to be introduced into the cylinder as the piston passes its BDC position and begins the compression cycle upwardly towards the valve 11. The valve will be held open during part of the compression stroke allowing a portion of air-fuel mixture to be forced back through the valve seat 12. At some predetermined point between the piston BDC position and the piston top dead center (TDC) position, the intake valve will close thereafter initiating compression of the air-fuel mixture. The dwell of the intake valve opening is determined by the engine throttle control system of the vehicle and transmitted by way of the control assembly 50 which shifts the auxiliary cam shaft by way of the lever mechanism 52.

Figure 2:
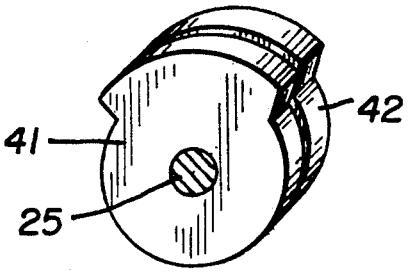
FIG. 2 is an enlarged perspective view of the split cam of the present invention showing the first fixed and second variable lobes in superimposed relationship with respect to one another in a position defining the minimum open duration for the intake valve of an internal combustion engine for developing maximum compression of air-fuel mixture to develop maximum power output for the engine.

When the power demand for the engine increases, the moveable cam lobe 42 of the inlet valve control valve 40 is rotated to a position where it is superimposed with respect to the constant phase or fixed lobe 41 of the cam 40, as is shown in FIG. 2. This positioning results in a minimum opening duration for the intake valve. Therefore, as the cylinder intakes a volume of air-fuel mixture after it is open, and as the piston reaches its BDC position, the intake valve will be caused to close causing a maximum compression of the complete air-fuel mixture within the cylinder thereby obtaining maximum power output for the engine.

It should be noted that the minimum to maximum intake valve duration or dwell timing can be effectively varied by the amount of fore and aft movement of the auxiliary cam shaft 26 relative to the input drive gear assembly 32.

Figure 6:
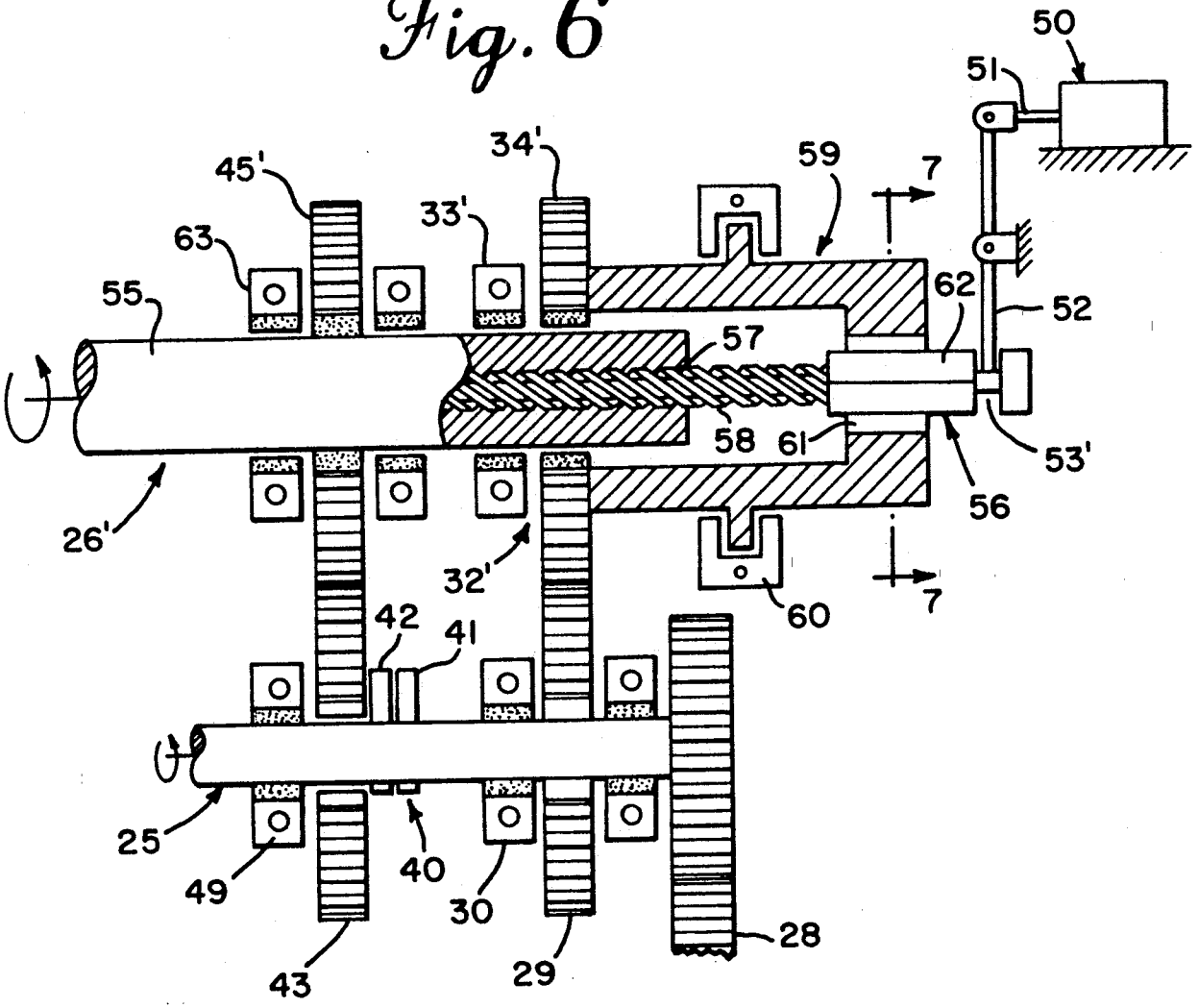
FIG. 6 is a partial cross-sectional top plan view of an alternate embodiment of an auxiliary cam shaft for use with the cam phase change mechanism of the present invention.
Figure 7:
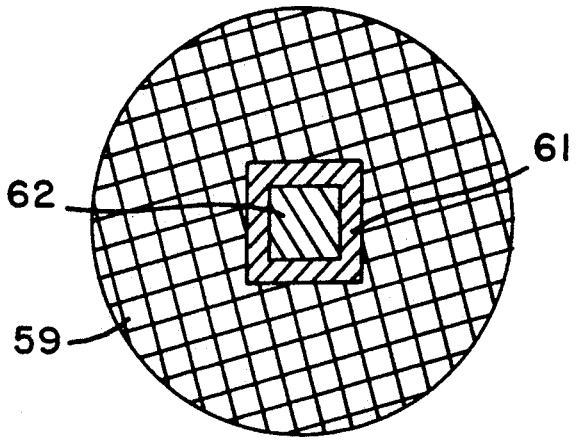
FIG. 7 is a cross-sectional view taken along lines 8—8 of FIG. 6.

With specific references to FIGS. 6–7, an alternate embodiment of auxiliary cam shaft for use in controlling the moveable intake cam lobe 42 is disclosed. In this embodiment, the auxiliary cam shaft 26' includes an axially non-shiftable segment 55 and a shiftable segment 56. The non-shiftable segment includes a socket formed at an end thereof having spiral gear teeth (or grooves) 57 formed therein which mesh with spiral gear teeth (or grooves) 58 formed along the outer end of the shiftable segment 56 of the auxiliary shaft. The input gear assembly 32' includes a gear 34' freely mounted about the non-shiftable shaft segment 55 and which is fixedly secured to a hat section 59. The hat section is stabilized by a thrust bearing assembly 60. The hat section includes a central bushing 61 which is shown as being square in cross-section in FIG. 7. The inner end 62 of the shiftable shaft segment 56 has an outer surface which is complimentary in configuration to the bushing. It should be noted that other complimentary configurations may be used to key the inner end 62 to the bushing 61. This keyed arrangement permits the hat section 59 to rotatably drive the shaft segment 56 while permitting the shaft segment to be shifted axially with respect thereto by control of the plunger assembly 50. In this embodiment, a groove 53' is provided in the shiftable segment 56 of the auxiliary cam shaft in which is seated the end of the pivot arm 52 associated with the slide 51 of the control assembly.

In the embodiment of FIGS. 6–7, as the hat section 59 drives the shiftable segment 56 of the auxiliary cam shaft 26', the non-shiftable segment 55 will be rotated therewith. However, upon the reciprocal movement of the shiftable segment 56 caused by control assembly 50, a rotational advancing or retarding of the non-shiftable segment 55 is created due to the spiral meshed engagement of these components.

As the shaft segment 55 of the auxiliary cam shaft 26' does not shift in the embodiment of FIG. 6–7, the drive control gear 45' is fixedly secured thereto. An auxiliary cam shaft support bearing is shown at 63 and a thrust bearing at 64. An additional bearing 33' is provided adjacent the gear wheel 34'.

In this embodiment, the drive control gear 45' rotates normally with the auxiliary cam shaft 26' at the same rate as the primary cam shaft 25, however, any rotational advancing or retarding imparted to the non-shiftable shaft segment 55 will advance or retard the drive control gear which meshes with the input cam control gear 43 thereof advancing or retarding the moveable lobe 42 of the intake control valve cam 40.

We claim:

1. A mechanism for controlling the duration of opening of the fuel intake valve of an internal combustion engine in response to an engine throttle control means wherein the engine includes a crankshaft, the mechanism comprising, a primary cam shaft, means for drivingly connecting the primary cam shaft to the crankshaft, a split intake valve control cam mounted to said primary cam shaft and having a first lobe which is fixed to said primary cam shaft and a second lobe which is freely mounted adjacent said first lobe and to said primary cam shaft, an auxiliary cam shaft having an elongated axis oriented generally parallel and spaced from said primary cam shaft, first gear means for drivingly connecting said primary cam shaft to said auxiliary cam shaft so that said cam shafts rotate at the same rate, a drive cam control gear means mounted to said auxiliary cam shaft, a driven cam control gear means freely mounted to said primary cam shaft and connected to said second lobe and being drivingly engaged with said drive cam control gear means, and means for axially shifting at least a portion of said auxiliary cam shaft relative to said primary cam shaft whereby the axial movement of said at least a portion of said auxiliary cam shaft rotates said drive cam control gear means to thereby rotate said second lobe relative to said first lobe of said split intake valve control cam, and means for drivingly connecting the intake valve to said split intake valve control cam.

2. The mechanism of claim 1 in which the entire auxiliary cam shaft is axial shiftable and said auxiliary cam shaft being axially displaceable with respect to said drive cam control gear means.

3. The mechanism of claim 2 in which said first gear means includes a drive gear fixedly mounted to said primary cam shaft and a driven gear mounted to said auxiliary cam shaft by interengaging helical splines and grooves, said drive gear and said driven gear being in rotational meshed relationship with respect to one another and means for retaining said driven gear in fixed relationship to said drive gear, whereby as said auxiliary cam shaft is shifted axially the rotational relationship between said driven gear and said drive gear is unaffected.

4. The mechanism of claim 3 in which said drive cam control gear means is connected to said auxiliary cam shaft by spline means which extend longitudinally of an generally parallel to said elongated axis of said auxiliary cam shaft, and bearing means for retaining said drive cam control gear means aligned with said driven cam control gear means.

5. The mechanism of claim 3 in which said means for connecting the intake valve to said split intake valve control cam includes a cam follower having first and second end portions, said cam follower being drivingly engaged by said split cam, a valve stem assembly extending from the intake valve, and means for connecting said valve stem assembly to said first end portion of said cam follower.

6. The mechanism of claim 5 in which said cam follower includes an opening therein, a pair of spaced internal lobes extending into said opening, said split intake valve control cam being disposed within said opening so that said first lobe thereof is engagable with said first internal lobe of said cam follower and said second lobe thereof is engagable with said second internal lobe of said cam follower.

7. The mechanism of claim 1 in which said first gear means includes a drive gear fixedly mounted to said primary cam shaft and a driven gear freely mounted about said auxiliary cam shaft, and means connecting said driven gear to normally rotatably drive said auxiliary cam shaft in synchronization with said primary cam shaft.

8. The mechanism of claim 7 in which said auxiliary cam shaft includes a first non-axially shifting segment and a second axially shifting segment which is meshed with said first segment so that said first and second segments are relatively rotatably and axially moveable relative to one another.

9. The mechanism of claim 8 in which said means for connecting said driven gear to drive said auxiliary cam shaft includes a hat means connected to said driven gear, a bushing in (of) said hat means through which said second segment of said auxiliary cam shaft is slideably received.

10. The mechanism of claim 9 in which said first segment of said auxiliary cam shaft includes an open socket end portion having a first spiral gear means therein, and said second segment includes an outer end including a second spiral gear means which is meshed with said first spiral gear means.

11. The mechanism of claim 10 in which said drive cam control gear means is fixed to said first segment of said auxiliary cam shaft.

12. The mechanism of claim 11 in which said means for connecting the intake valve to said split intake valve control cam includes a cam follower having first and second end portions, said cam follower being drivingly engaged by said split cam, a valve stem assembly extending from the intake valve, and means for connecting said valve stem assembly to said first end portion of said cam follower.

13. The mechanism of claim 12 in which said cam follower includes an opening therein, a pair of spaced internal lobes extending into said opening, said split intake valve control cam being disposed within said opening so that said first lobe thereof is engagable with said first internal lobe of said cam follower and said second lobe thereof is engagable with said second internal lobe of said cam follower.

14. The mechanism of claim 1 in which said means for connecting the intake valve to said split intake valve control cam includes a cam follower having first and second end portions, said cam follower being drivingly engaged by said split cam, a valve stem assembly extending from the intake valve, and means for connecting said valve stem assembly to said first end portion of said cam follower.

15. The mechanism of claim 14 in which said cam follower includes an opening therein, a pair of spaced internal lobes extending into said opening, said split intake valve control cam being disposed within said opening so that said first lobe thereof is engagable with said first internal lobe of said cam follower and said second lobe thereof is engagable with said second internal lobe of said cam follower.

16. A mechanism for controlling the duration of opening of the fuel intake valve of an internal combustion engine in response to an engine throttle control means wherein the engine includes a crankshaft, the mechanism comprising, a primary cam shaft, means for drivingly connecting the primary cam shaft to the crankshaft, a split intake valve control cam mounted to said primary cam shaft and having a first lobe which is fixed to said primary cam shaft and a second lobe which is freely mounted adjacent said first lobe and to said primary cam shaft, an auxiliary cam shaft having an elongated axis oriented generally parallel and spaced from said primary cam shaft and having first and second segments, first gear means for drivingly connecting said primary cam shaft to said auxiliary cam shaft so that said cam shafts rotate at the same rate, a drive cam control gear means mounted to said auxiliary cam shaft, a driven cam control gear means freely mounted to said primary cam shaft and connected to said second lobe and being drivingly engaged with said drive cam control gear means, and means for axially shifting one of said first and second segments relative to one another to thereby rotate the other of said first and second segments relative to said primary cam shaft whereby the axial movement of said one of said first and second segments of said auxiliary cam shaft rotates said drive cam control gear means to thereby rotate said second lobe relative to said first lobe of said split intake valve control cam, and means for drivingly connecting the intake valve to said split intake valve control cam.

* * * * *